United States Patent [19]

Luchonok

[11] Patent Number: 5,005,237

[45] Date of Patent: Apr. 9, 1991

[54] MATTRESS CORNER ADHESION PATCHES

[75] Inventor: Jeffrey J. Luchonok, Redondo Beach, Calif.

[73] Assignee: Advanced Sleep Products, Redondo, Calif.

[21] Appl. No.: 570,536

[22] Filed: Aug. 21, 1990

[51] Int. Cl.[5] ..... A47C 27/08; A47C 31/00

[52] U.S. Cl. ..... 5/451; 5/460; 5/474; 24/72.5

[58] Field of Search ..... 5/451, 450, 452, 449, 5/455, 441, 460, 474, 508, 498, 496; 24/72.5; 428/79, 192

[56] References Cited

U.S. PATENT DOCUMENTS

| | | | |
|---|---|---|---|
| 4,147,828 | 4/1979 | Heckel et al. | 428/255 |
| 4,914,761 | 4/1990 | Boyd | 5/451 |
| 4,930,172 | 6/1990 | Johenning | 5/451 |

*Primary Examiner*—Alexander Grosz
*Attorney, Agent, or Firm*—Kinzer, Plyer, Dorn, McEachran & Jambor

[57] ABSTRACT

A water mattress construction includes an outer water inflatable polyvinyl chloride ("PVC") shell having a top and a bottom surface with side walls connecting the top and bottom surfaces and forming corners where any two side walls meet. The mattress is improved by attaching one or more patches of webbing made of a laminated spun bound polyester encased in PVC to the mattress shell. The webbing having intermittent raised areas and intermittent openings is preferably attached to the four corners of the mattress to provide a frictional gripping adhesion between the bed clothing and the mattress to prevent sliding movement of the bed clothing on the mattress.

7 Claims, 2 Drawing Sheets

MATTRESS CORNER ADHESION PATCHES

SUMMARY OF THE INVENTION

The present invention relates generally to the construction of a waterbed and more specifically to the use of no-skid patches on the mattress to maintain the bed clothing in position. One object of this invention is to provide a water mattress with sufficient frictional surface to maintain the desired position of sheets on the mattress.

Another object of this invention is to eliminate the need for the difficult to use elastic bands.

A further object of this invention is to eliminate the need for a separate padding to interact with the mattress and the sheets.

Another further object of this invention is to supply a water mattress with the adhesion needed to keep the sheets of a waterbed in the desired position, covering the mattress.

Other purposes will appear in the ensuing specification, drawings and claims.

DESCRIPTION OF THE PREFERRED EMBODIMENT

A common problem of people who own waterbeds is that it has become difficult to keep the sheets and other bed clothing in place on the water mattress. A conventional mattress made of cloth, foam rubber and springs will usually be able to maintain the advantageous position of the sheets by employing a fitted sheet which is supplied with elastic strap sewn into the corners of the sheets. The elastic staps can be stretched to fit over the sides and under the bottom of the mattress to hold the sheet in place. The conventional mattress can also maintain the sheets on a bed by using a flat sheet which is usually an over sized piece of cloth that can be tucked under the mattress where the weight of the mattress holds the sheet in place. Presently, the use of a fitted sheet or a flat sheet on a waterbed must employ reinforcement by the use of a padding and or an elastic band. The padding is a separate piece of material which covers the entire top surface of the mattress. This padding provides a frictional surface for the sheets to interact with in order to maintain their position on the mattress. The elastic band employs a section of elastic with the ends sewn to the edges of a sheet. They are used under a mattress to draw two adjoining sides of a sheet closer together. These elastic bands are sometimes difficult to install and can frequently malfunction which prevents the sheets from maintaining their position on the mattress. The present invention provides a reliable and inexpensive method of retaining sheets in position on a water mattress.

Figure 1:
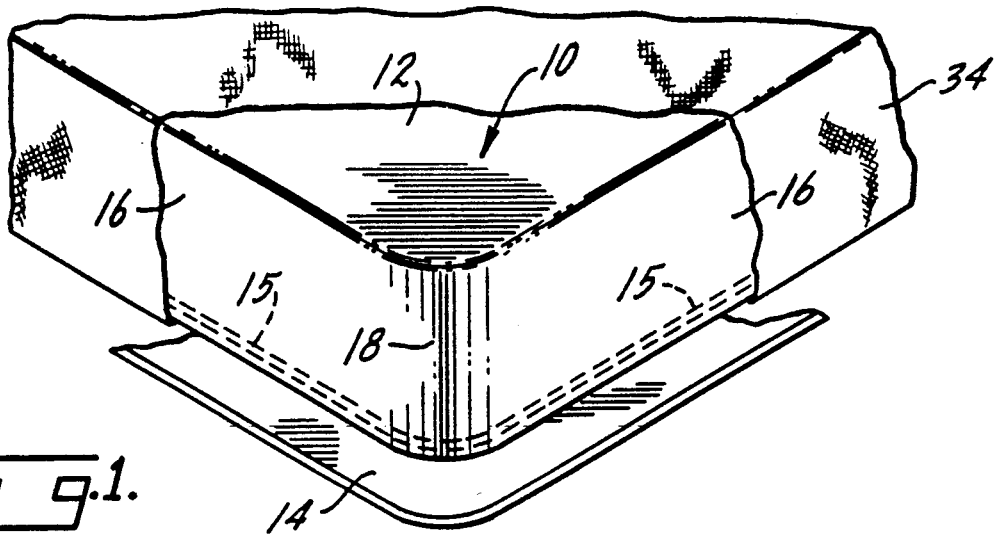
FIG. 1 is a partially cut-away and partially exploded perspective view of a corner of a water mattress.

In FIG. 1 of the drawings, a water mattress 10 is constructed of a mattress top sheet 12 and a bottom sheet 14. Both the top 12 and the bottom 14 are preferably formed of durable polyvinyl chloride ("PVC"). In manufacturing the mattress, the top sheet 12 will include side walls 16 and the side walls will be heat sealed to form the four corners 18 of the mattress 10 and the bottom 14 will be heat sealed to the lower edges 15 of the side walls 16. It should be understood that the partial exploded views of FIGS. 1 and 2 are representative of each of the four corners 18 of a water mattress 10.

Figure 2:
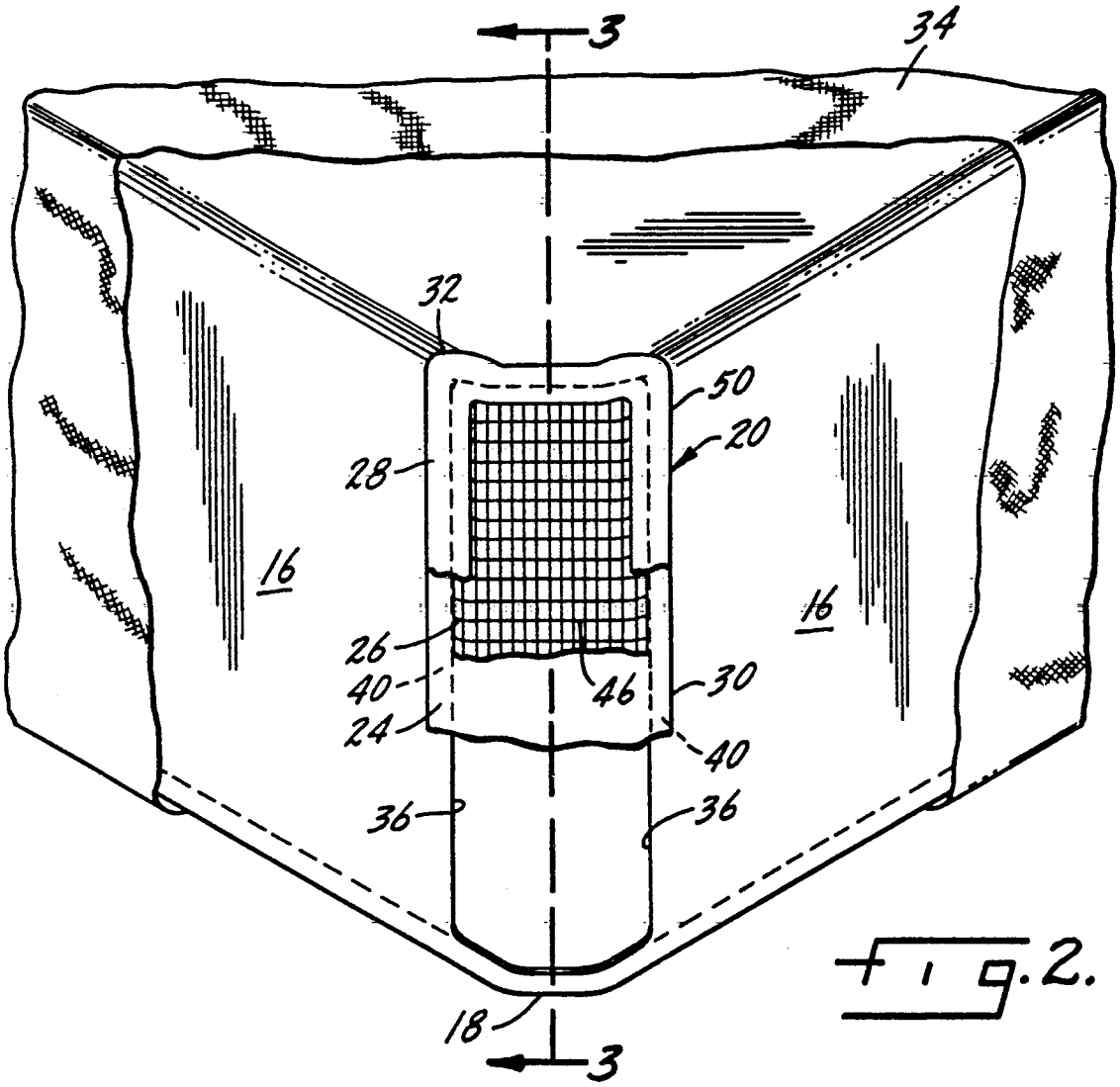
FIG. 2 is an enlarged cut-away perspective view of a corner of a water mattress employing the invention.

Referring now to FIG. 2, a gripping patch 20 is sealed to each corner 18. The gripping patch 20 is assembled by heat sealing a backing 24 to the portions of the side walls 16 adjacent each corner 18. A patch of webbing 26 is then secured to the backing 24 with a border 28.

The backing 24, generally rectangular in shape but with rounded corners 32, is formed of a PVC similar to that used in the top and bottom sheets 12, 14. The size of the rectangle corresponds generally to the height of the water mattress 10. The backing 24 covers a surface area that is sufficient in size to provide a gripping patch 20 with sufficient area to maintain a sheet or other bed clothing 34 in position on the water mattress 10.

Figure 3:
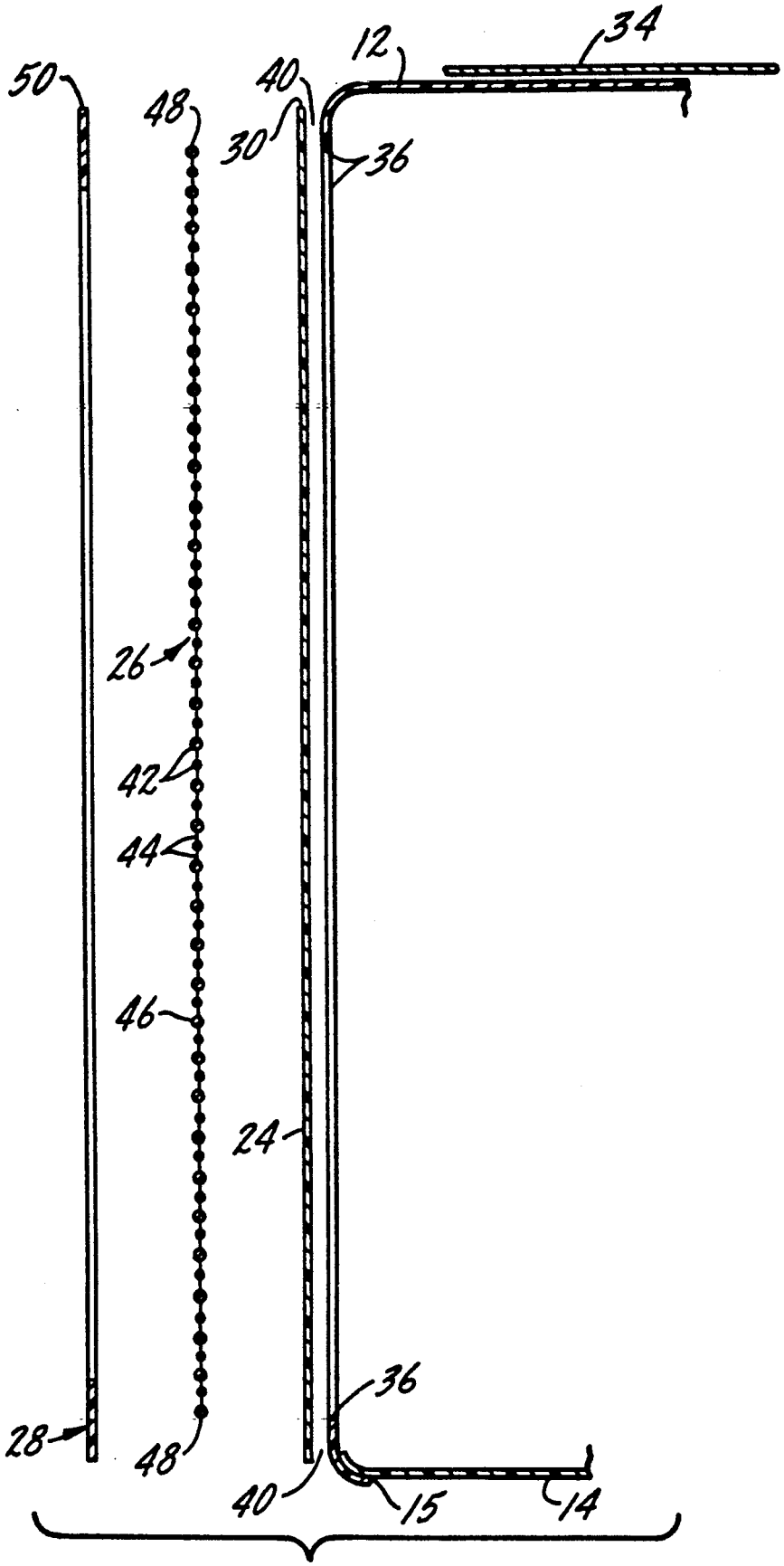
FIG. 3 is an exploded cross sectional view of the corner shown in FIG. 2 along the plane 3—3.

The backing 24 is secured to the mattress shell by first cutting a similarly rounded rectangular section out of the side walls 16 adjacent each corner 18. As shown in FIG. 3, the edges 36 of the side walls 16 at each corner 18 are overlapped by backing 24. These over lapping areas are heat sealed, as at 40, to maintain a water tight mattress 10.

The webbing 26 is a piece of laminated spun bound polyester which has been encased in PVC. The webbing 26 is formed to provide a series of raised areas 42 alternating with a series of areas having a succession of openings 44. The relationship between the raised areas 42 and the succession of openings 44 along with the type of PVC used to encase the webbing provides the necessary frictional adhesion required to inhibit movement of bed clothing 34 when it is pulled across the surface 46 of the webbing 26.

The webbing 26 is cut to a shape which is slightly smaller than the backing 24. To increase the useful life of the webbing 26, the border 28 is secured over the edges 48 of the webbing 26. The border 28 is a piece of PVC having an outer edge 50 that is generally coextensive with the outer edges 30 of the backing 24. The gripping patch 20 is formed by aligning the backing 24, the webbing 26, and the border 28 in the relationship of FIG. 3 and then heat sealing the four layers together to form a water tight mattress 10 with gripping patches 20 on each corner 18.

The invention should not be limited to the structure shown in the drawings. For example the gripping patches may be used on waterbeds as well as on conventional mattresses; on rectangular as well as circular shaped mattresses; attached to a mattress as well as to bed clothing; on the corners as well as the side, top and or bottom surfaces of the mattress and/or bed clothing; and constructed with webbing of laminated spun bound polyester encased in PVC as well as any other similarly gripping frictional providing material.

Whereas the preferred form of the invention has been shown and described herein, it should be realized that there may be many modifications, substitutions and alterations thereto.

The embodiments of the invention in which an exclusive property or privilege is claimed are defined as follows:

1. In a water mattress, an outer water fillable shell having a top surface, a bottom surface, connecting side walls and a corner where any two surfaces meet, means on said shell for providing an area which is formed and adapted to frictionally grip bed clothing on the water mattress shell and prevent sliding movement thereof, including a webbing attached to the surface of said water mattress shell, a border having an outer circumference and an inner circumference, said inner circumference being fixedly attached to said webbing and said outer circumference being fixedly attached to said mattress shell to secure said webbing to a desired location on said water mattress shell.

2. The water mattress as defined in claim 1 wherein said gripping means is on the side walls.

3. The water mattress as defined in claim 2 wherein said gripping means is on one or more side wall corners.

4. The water mattress as defined in claim 2 wherein said shell is rectangularly shaped and having said gripping means on all four corners.

5. The water mattress as defined in claim 1 wherein said webbing has intermittent raised areas and intermittent openings.

6. The water mattress as defined in claim 1 wherein said gripping means includes a backing sealed to adjacent edges on said water mattress shell.

7. The water mattress as defined in claim 1 wherein said rubbing is composed of a laminated spun bounded polyester encased in a polyvinyl chloride.

* * * * *